US010631665B2

(12) United States Patent
Loucks

(10) Patent No.: US 10,631,665 B2
(45) Date of Patent: Apr. 28, 2020

(54) CUTLERY DISPENSING ASSEMBLIES AND METHODS

(71) Applicant: GPCP IP Holdings LLC, Atlanta, GA (US)

(72) Inventor: Kyle Loucks, Vancouver, WA (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/226,813

(22) Filed: Dec. 20, 2018

(65) Prior Publication Data

US 2019/0223621 A1 Jul. 25, 2019

Related U.S. Application Data

(60) Provisional application No. 62/621,541, filed on Jan. 24, 2018.

(51) Int. Cl.
*A47F 1/10* (2006.01)
*A47G 21/06* (2006.01)

(52) U.S. Cl.
CPC ..... *A47F 1/10* (2013.01); *A47F 2001/103* (2013.01); *A47G 21/06* (2013.01)

(58) Field of Classification Search
CPC ..... A47F 1/10; A47F 1/04; A47F 2001/103; A47G 21/00; A47G 21/14; A47G 21/02
See application file for complete search history.

(56) References Cited

U.S. PATENT DOCUMENTS 2,868,344 A 1/1959 Sheilds
2,877,926 A 3/1959 Abbe
(Continued)

FOREIGN PATENT DOCUMENTS

CA 3020168 A1 10/2017
CA 3021819 A1 11/2018
(Continued)

OTHER PUBLICATIONS

International Search Report and Written Opinion for PCT/US07/83752, dated Mar. 11, 2008.
(Continued)

*Primary Examiner* — Gene O Crawford
*Assistant Examiner* — Ayodeji T Ojofeitimi

(57) ABSTRACT

Cutlery dispensing assemblies and methods for making and using same. In some examples, the cutlery dispensing assembly can include a chassis comprising a backbone, an upper support frame located at an upper end of the backbone, and a base located at a lower end of the backbone. A skewer mechanism can be at least partially disposed within the chassis and configured to contain a stack of the cutlery. The stack of the cutlery can include a bottom piece of cutlery and at least one other piece of cutlery. Each piece of cutlery can have an opening through which the skewer mechanism is configured to pass. The skewer mechanism can include an elongated body that is configured to pass through the opening of each piece of cutlery, and a lever extending from elongated the body. The lever can be configured to move between a first position in which the lever retains a separated piece of cutlery, and a second position in which the lever releases the separated piece of cutlery from the lever, wherein the bottom piece of cutlery becomes the separated piece of cutlery after it has been separated from the stack of the cutlery.

20 Claims, 6 Drawing Sheets

(56) References Cited

U.S. PATENT DOCUMENTS

| | | | | |
|---|---|---|---|---|
| 2,880,907 | A | 4/1959 | Mainers | |
| 2,911,127 | A | 11/1959 | Driss et al. | |
| 2,924,357 | A | 2/1960 | Kingsley et al. | |
| 2,954,948 | A | 10/1960 | Johnson | |
| 2,965,262 | A | 12/1960 | Dubois et al. | |
| 3,028,048 | A | 4/1962 | Klammer | |
| 3,371,821 | A | 3/1968 | Abood, Jr. | |
| 3,428,215 | A | 2/1969 | Wells | |
| 3,558,006 | A | 1/1971 | Redmond et al. | |
| 3,587,922 | A | 6/1971 | Biagio Oriti | |
| 3,680,736 | A | 8/1972 | Viessmann | |
| 3,747,803 | A | 7/1973 | Zoepf et al. | |
| 3,786,959 | A | 1/1974 | Greb | |
| 4,308,974 | A | 1/1982 | Jones | |
| 4,489,854 | A | 12/1984 | Wenkman et al. | |
| 4,530,445 | A | 7/1985 | Decker | |
| 4,789,064 | A | 12/1988 | Segal | |
| 4,896,792 | A | 1/1990 | Marchand | |
| 5,246,138 | A | 9/1993 | Blevins, Jr. | |
| 5,904,250 | A * | 5/1999 | De Schutter | B65D 71/00 206/553 |
| D461,663 | S | 8/2002 | Tucker et al. | |
| 6,832,694 | B2 | 12/2004 | Goeking et al. | |
| 6,837,028 | B1 | 1/2005 | Miano et al. | |
| 8,152,004 | B2 | 4/2012 | Smith et al. | |
| 8,210,364 | B2 | 7/2012 | Smith et al. | |
| 8,272,533 | B1 * | 9/2012 | D'Amelia | A47F 1/10 221/172 |
| 8,297,473 | B2 | 10/2012 | Smith | |
| 8,360,273 | B2 | 1/2013 | Reinsel et al. | |
| 9,049,948 | B2 | 6/2015 | Jongen et al. | |
| 9,226,598 | B1 | 1/2016 | Knope et al. | |
| 9,700,153 | B2 | 7/2017 | Snyder et al. | |
| 10,051,976 | B2 | 8/2018 | Smith | |
| 2002/0112445 | A1 | 8/2002 | Scaduto | |
| 2004/0089670 | A1 | 5/2004 | Goeking et al. | |
| 2007/0108141 | A1 | 5/2007 | Smith et al. | |
| 2007/0131705 | A1 | 6/2007 | Behravesh et al. | |
| 2007/0193968 | A1 * | 8/2007 | Smith | A47F 1/10 211/70.7 |
| 2008/0072432 | A1 | 3/2008 | Teys et al. | |
| 2008/0121650 | A1 | 5/2008 | Smith | |
| 2008/0128445 | A1 | 6/2008 | Huang et al. | |
| 2011/0226797 | A1 | 9/2011 | Reinsel et al. | |
| 2011/0296693 | A1 * | 12/2011 | Oakes | A47G 21/06 30/142 |
| 2012/0145734 | A1 * | 6/2012 | Walters | A47F 1/10 221/1 |
| 2012/0145735 | A1 * | 6/2012 | Erickson | A47F 1/10 221/1 |
| 2013/0043272 | A1 * | 2/2013 | Oakes | A47F 1/125 221/279 |
| 2015/0041484 | A1 * | 2/2015 | Oakes | A47F 1/126 221/1 |
| 2015/0048108 | A1 * | 2/2015 | Borke | B65D 73/02 221/195 |
| 2015/0289679 | A1 * | 10/2015 | Oakes | A47F 1/125 221/1 |
| 2017/0354270 | A1 * | 12/2017 | Oakes | A47F 1/10 |
| 2019/0029443 | A1 * | 1/2019 | Smith | A47F 1/10 |
| 2019/0038045 | A1 * | 2/2019 | Smith | A47F 1/10 |
| 2019/0075940 | A1 | 3/2019 | Pierson et al. | |
| 2019/0281996 | A1 * | 9/2019 | Smith | A47F 1/10 |

FOREIGN PATENT DOCUMENTS

| | | | |
|---|---|---|---|
| CN | 103919421 | A | 7/2014 |
| CN | 203828595 | U | 9/2014 |
| CN | 103919422 | B | 7/2015 |
| CN | 103960919 | B | 2/2017 |
| PL | 200112 | A1 | 12/2008 |
| WO | 0105281 | A | 1/2001 |
| WO | 2001005280 | A1 | 1/2001 |
| WO | 2004028309 | A1 | 4/2004 |
| WO | 2008058187 | A2 | 5/2008 |
| WO | 2016155644 | A1 | 10/2016 |
| WO | 2017139525 | A1 | 8/2017 |
| WO | 2017139527 | A1 | 8/2017 |
| WO | 2018006062 | A1 | 1/2018 |

OTHER PUBLICATIONS

International Search Report and Written Opinion for PCT/US2007/083922, dated Nov. 17, 2008.
International Search Report and Written Opinion for PCT/US2009/059915, dated Feb. 3, 2010.
International Search Report and Written Opinion for PCT/US2011/058767 dated Feb. 29, 2012.
International Search Report and Written Opinion for PCT/US2011/064057 dated Feb. 29, 2012.
International Search Report and Written Opinion for PCT/US2011/058329 dated Feb. 29, 2012.
International Search Report and Written Opinion for PCT/US2010/000051, dated Aug. 16, 2010.
International Search Report and Written Opinion for PCT/US2014/050166, dated Nov. 20, 2014.
International Search Report and Written Opinion for PCT/US2014/050169, dated Jan. 9, 2015.
International Search Report and Written Opinion for PCT/US2017/037233, dated Sep. 5, 2017.
International Search Report and Written Opinion for International Application No. PCT/US2013/022455, mailed by the International Searching Authority dated May 30, 2013.
International Search Report and Written Opinion for International Application No. PCT/US2019/014137 dated 6, 2019.

* cited by examiner

CUTLERY DISPENSING ASSEMBLIES AND METHODS

CROSS REFERENCE TO RELATED APPLICATIONS

This application claims the benefit of and priority to U.S. Provisional Application No. 62/621,541, filed on Jan. 24, 2018, and entitled "CUTLERY DISPENSING ASSEMBLIES AND METHODS", the contents of which are hereby incorporated by reference in its entirety.

BACKGROUND

Field

Embodiments described generally relate to cutlery dispensing assemblies and methods for making and using same.

Description of the Related Art

Disposable cutlery can typically be found in fast-food and take out restaurants. Such restaurants allow consumers the ability to select various types of cutlery that they wish to use by taking the cutlery from a publicly accessible dispenser or bin. Some conventional cutlery dispensers can provide selected cutlery in response to the consumer actuating a handle. Following actuation of the handle, the selected cutlery can drop into a cutlery landing surface and the consumer can then remove the cutlery from the cutlery landing surface. This conventional system is not ideally hygienic because the consumer must first actuate a handle that drops a piece of cutlery into a cutlery landing surface. The handle and the cutlery landing surface can be touched by every consumer, and are exposed to air-borne agents. Moreover, the cutlery landing surface is susceptible to trapping foreign objects and debris. Due to such conditions, especially the repeated contact by consumers and exposure to the surrounding environment, there is an opportunity to develop improvements.

Conventional cutlery dispensers have been used to provide a confined and controlled protective environment for cutlery housed within. Some assemblies, however, have challenges and issues delivering cutlery to a consumer in a repeatable and reliable manner. For example, cutlery pieces can get stuck in the dispenser. Some conventional cutlery dispensers have tried to control the cutlery within the dispenser using the outside edges of the cutlery within guide rails. Controlling the orientation of the cutlery using only the edges of the cutlery, however, can create an instability that causes the cutlery to flip or roll. This lack of control over the orientation of the cutlery within the dispenser can cause the cutlery to jam, which prevents it from dispensing cutlery to the customers.

There is a need, therefore, for a hygienic cutlery dispenser that can control the orientation of its cutlery to prevent jamming for reliable customer use and enjoyment.

SUMMARY

Cutlery dispensing assemblies and processes for making and using same are provided. In some examples, the cutlery dispensing assembly can include a chassis having a backbone, an upper support frame located at an upper end of the backbone, and a base located at a lower end of the backbone. In certain embodiments, a cutlery landing surface can be connected to the chassis between the upper support frame and the base. A skewer mechanism can be disposed on the chassis. The skewer mechanism can include an elongated body having a first end and a second end. The first end can be connected to the chassis, and the second end can be configured to fit within a piece of cutlery to be disposed from the dispenser. A lever can be disposed on the second end of the body. The lever can be configured to move between a first position in which the lever retains the cutlery, and a second position in which the lever releases the cutlery from the cutlery landing surface to a user.

DETAILED DESCRIPTION

Figure 1:
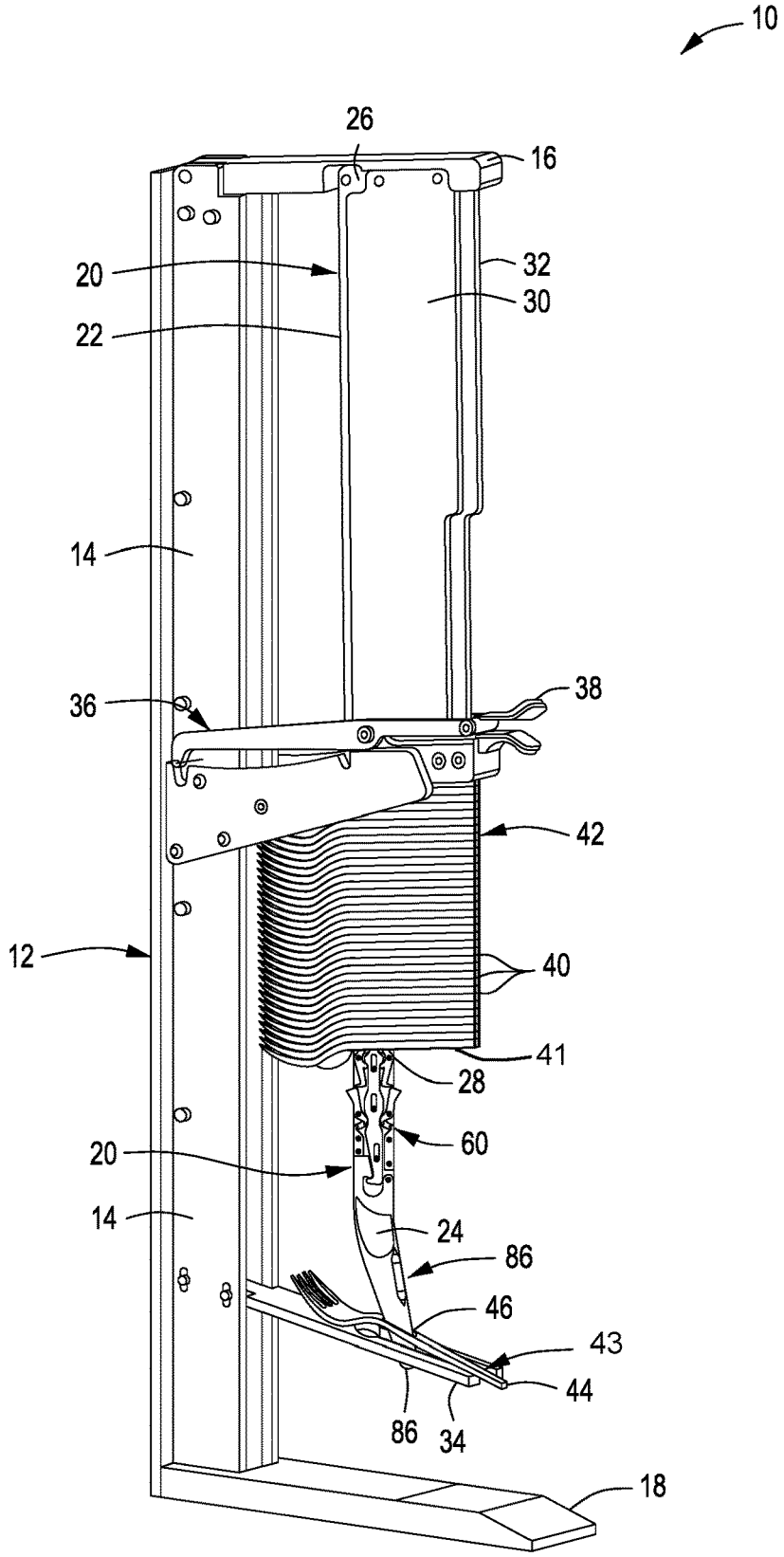
FIG. 1 depicts a piece of cutlery dispensing assembly, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure. The figures are not necessarily to scale, and certain features and certain views of the figures may be shown exaggerated in scale or in schematic for clarity and/or conciseness Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

FIG. 1 depicts a cutlery dispensing assembly 10, according to one or more embodiments. Cutlery dispensing assembly 10 can include a body or chassis 12, having a backbone 14, an upper support frame 16 and a base 18. The backbone 14 can be substantially vertical, and can serve as a support structure for the upper support frame 16 and base 18. The upper support frame 16 can be connected to an upper portion of the backbone 14, and the base 18 can be connected to a lower portion of the backbone 14. A skewer mechanism 20 can be disposed and appended from the chassis 12.

Figure 2:
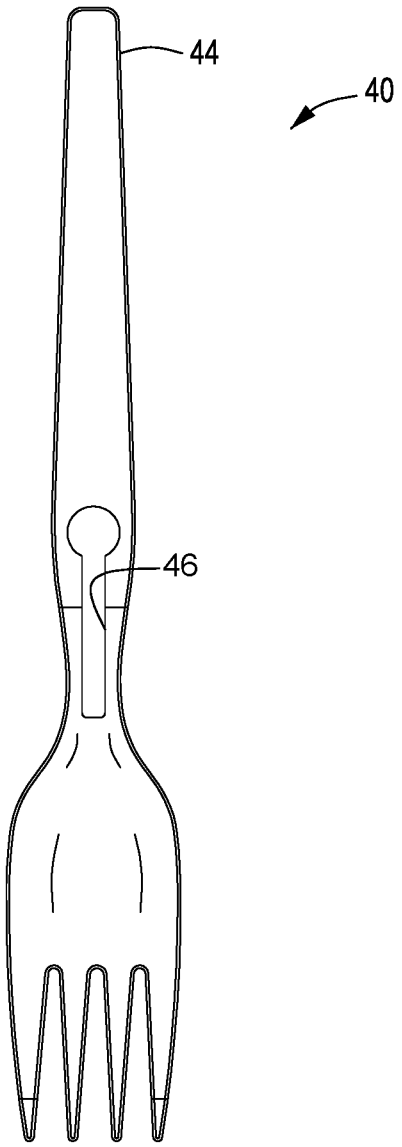
FIG. 2 depicts a piece of cutlery, according to one or more embodiments described.

The cutlery dispensing assembly 10 can be used to dispense cutlery 40 which can be grouped into a cutlery stack 42. FIG. 2 depicts a single piece of cutlery 40, according to one or more embodiments described. Each piece of cutlery 40 can be or can include any combination of a fork, knife, spoon, and/or other eating utensil having the slot 46. No matter what functional end is used (i.e. knife, fork, spoon or other), each piece of cutlery 40 can include a handle 44, having a slot 46 defined therein. The slot 46 can be formed through the handle 44 and have any suitable shape and size. The slot 46, for example, can have a combination of shapes, such as a generally rectangular shaped portion that terminates at one end into a circular portion, as shown. The rectangular portion, however, could be any other suitable polygonal shape, and the circular portion could be any other round, oval, or elliptical shape. The slot 46 can be positioned at or near a center of gravity of the cutlery 40 or other suitable location.

The cutlery stack 42 can include multiple pieces of cutlery 40 of the same or different types and the cutlery 40 can be arranged on the skewer mechanism 20 such that the skewer mechanism 20 extends through the slots 46 of the cutlery 40 in the cutlery stack 42. The skewer mechanism 20 can have a cross sectional shape that is complementary to the shape of the slots 46. The skewer mechanism 20 can maintain the cutlery 40 in the cutlery stack 42 in the same orientation as one another by restraining the cutlery 40 from rotational movement about the skewer mechanism 20 using the cross-sectional shape of the skewer mechanism 20 to engage the slots 46 of the cutlery 40. The skewer mechanism 20 also can restrain the cutlery from rotating or flipping.

Referring again to FIG. 1, the skewer mechanism 20 can have an elongated body 22 and a lever 24. The elongated body 22 can have a first end 26, which can be connected to the chassis 12 at the backbone 14, base 18, or upper support frame 16, and a second end 28 to which the lever 24 can be connected. The elongated body 22 can connect to the chassis 12 or to the upper support frame 16 and pivot in each case such that upper support frame 16 need not pivot to load the dispensing assembly 10, as further explained below. The elongated body 22 can control the orientation of the cutlery 40 in the cutlery stack 42 and can support the cutlery 40 while the cutlery 40 is in the cutlery dispensing assembly 10. The skewer mechanism 20 can further include a first guide or side panel 30 and a second guide or side panel 32. The first and second guides 30, 32 can provide opposing sidewalls for the body 22, which helps contain the stack of cutlery 42.

Still referring to FIG. 1, the cutlery dispensing assembly 10 can further include a cutlery landing surface 34 which can extend outward from the backbone 14 or any other suitable portion of the dispenser. The cutlery landing surface 34 can be pivotally connected or affixed to the backbone 14. The cutlery landing surface 34 can be any generally flat surface to provide a landing area for a separated piece of cutlery 43. The cutlery landing surface 34 can include a cutout, slot, channel or other type of opening 34A to allow for at least a portion of the lever 24 to pass through. (See also FIG. 6. (The position and angle or the cutlery landing surface 34 can be adjusted to accommodate the movement of the lever 24. The cutlery landing surface 34 can be angled downward, relative to the centerline of the backbone 14, such as at an angle greater than 80°, greater than 88°, greater than 100°, greater than 110°, greater than 120°, greater than 130°, greater than 140°, greater than 150°, greater than 160°, between 90° and 180°, or between 90° and 150°. The cutlery landing surface 34 can support a separated piece of cutlery 43 such that a user or consumer can grasp the handle 44. The cutlery landing surface 34 can be arranged with a larger or smaller angle relative to the backbone 14.

In FIG. 1, the skewer mechanism 20 is shown in a dispensing position in which the cutlery dispensing assembly 10 is ready to dispense a piece of cutlery 40 to the consumer. During use of the cutlery dispensing assembly 10, the consumer can grasp the handle 44 of the separated piece of cutlery 43 that is positioned on the cutlery landing surface 34. The consumer can then pull the separated piece of cutlery 43 free from the cutlery dispensing assembly 10 without having to touch any part of the cutlery dispensing assembly 10.

Figure 3:
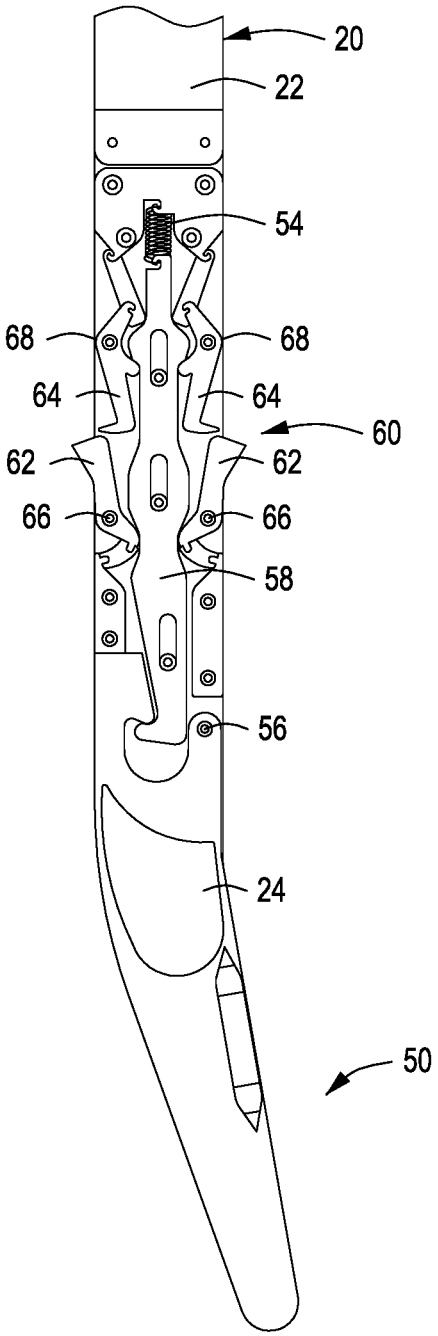
FIG. 3 depicts a lever of a skewer mechanism of the cutlery dispensing assembly in a resting position, according to one or more embodiments described.
Figure 4:
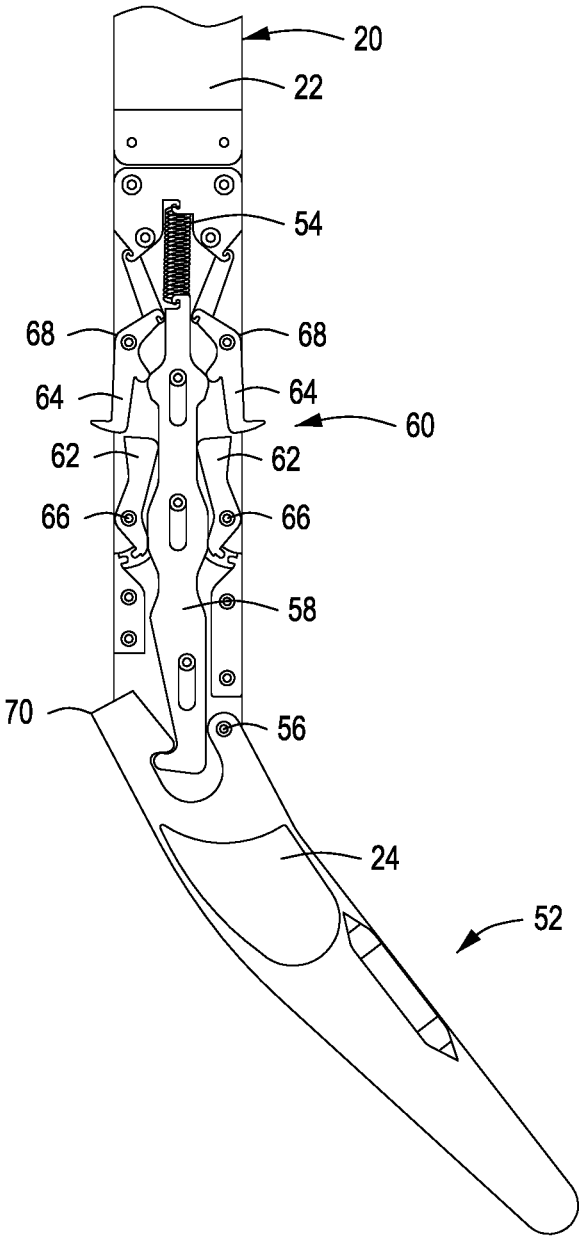
FIG. 4 depicts the lever of a skewer mechanism of the cutlery dispensing assembly in an actuated position, according to one or more embodiments described.

FIG. 3 depicts the lever 24 in a first or resting position 50, according to one or more embodiments. FIG. 4 depicts the lever 24 in a second or actuated position 52, according to one or more embodiments. When the lever 24 is in the resting position (FIGS. 1 and 3), the lever 24 can be positioned adjacent to the cutlery landing surface 34 and a separated piece of cutlery 43 ready for dispensing to the consumer can be held in position on the cutlery landing surface 34 by the lever 24 extending through the slot 46. When a consumer grasps the handle 44 of the separated piece of cutlery 43 and pulls, the lever 24 can move from the resting position 50 to an actuated position 52. In the actuated position 52, the separated piece of cutlery 43 can be released from the cutlery dispensing assembly 10 dispensed to the consumer. The pulling motion of the consumer taking the separated piece of cutlery 43 from the cutlery dispensing assembly 10 allows the slot 46 to engage or otherwise contact the lever 24, moving the lever 24 from the resting position 50 to the actuated position 52. When the lever 24 has moved far enough away from the landing surface 34, in its actuated position 52, the slot 46 can release from lever 24, allowing the separated piece of cutlery 43 to slide off the skewer mechanism 20 and free the separated piece of cutlery 43 from the cutlery dispensing assembly 10 for the consumer to take and use.

When the lever 24 is in the resting position 50, the lever 24 can guide the separated piece of cutlery 43 to the cutlery landing surface 34 from a position higher on the skewer mechanism 20. The separated piece of cutlery 43 can fall under the force of gravity to the cutlery landing surface 34 while the lever 24 guides the separated piece of cutlery 43. The lever 24 can be connected at a pivot 56 and the movement between the resting position 50 and the actuated position 52 can be a rotational movement about the pivot 56. The skewer mechanism 20 can include a sliding cam 58 which can move in response to the movement of the lever 24 between the resting position 50 and the actuated position 52. The skewer mechanism 20 can include a lever spring 54, which can return the lever 24 to the resting position 50 from the actuated position 52. The lever spring 54 can be connected to the sliding cam 58 to move the sliding cam and to return the lever 24 to the resting position 50.

The skewer mechanism 20 can include a singularizing mechanism 60 that can separate a bottom piece cutlery 41 from the cutlery stack 42 which can have multiple cutlery 40. The term "bottom piece of cutlery" can mean the piece of cutlery in the cutlery stack 42 that is closest to the cutlery landing surface 34. There term "bottom" is used for convenience and could refer to a top piece of cutlery if the cutlery landing surface 34 were located above the cutlery stack 42, so that the cutlery 40 is dispensed from the top of the cutlery stack 42.

The singularizing mechanism 60 (FIGS. 1, 3 and 4) can include a first retractable surface 62 that can extend out and away from the singularizing mechanism 60 (FIG. 3) when the lever 24 is in the resting position 50 and can retract toward or into the singularizing mechanism 60 (FIG. 4) when the lever 24 is in the actuated position 52. By "retractable" it is meant that the surface is capable of moving, deflecting, pivoting, or otherwise moving away from the singularizing mechanism 60. The first retractable surface 62 can be any type of detent, extension, barb, ledge, hook, or other extension. The first retractable surface 62 can also be wedge shaped. The first retractable surface 62 can extend generally parallel to the handle 44, generally perpendicular to the handle 44, or along any axial direction between. The first retractable surface 62 can be sized and shaped such that the slot 46 of the cutlery 40 can slide past the first retractable surface 62 as the cutlery 40 is loaded onto the skewer mechanism 20.

The singularizing mechanism 60 can include a second retractable surface 64 that can retract toward or into the singularizing mechanism 60 when the lever 24 is in the resting position 50 (FIG. 3). The second retractable surface 64 can extend away from or out of the singularizing mechanism 60 when the lever 24 is in the actuated position 52. The second retractable surface 64 can be or can include one or more barbs, ledges, hooks, or any other retractable surface.

The second retractable surface 64 can be wedge shaped. The second retractable surface 64 can extend generally parallel to the handle 44 of the next utensil in the stack, generally perpendicular to the handle 44, or along any axial direction there between. The second retractable surface 64 can extend greater than 10°, greater than 20°, greater than 30°, greater than 50°, greater than 90°, greater than 180°, greater than 270°, or 360° around the center vertical axis of the singularizing mechanism 60. The first retractable surface 62 can include first retractable surface springs 66 that can bias the first retractable surface 62 to extend away from or out of the singularizing mechanism 60. The second retractable surface 64 can include second retractable surface springs 68 that can bias the second retractable surface 64 to retract into the singularizing mechanism 60.

When the first retractable surface 62 is extended out and away from the singularizing mechanism 60, the cross section of the singularizing mechanism 60 at the first retractable surface 62 can be larger than the slots 46 in the cutlery 40. When the first retractable surface 62 is extended, the pieces of cutlery 40 are restrained from moving past the first retractable surface 62 to the lever 24 or to the cutlery landing surface 34. The first retractable surface 62 can hold the cutlery stack 42 (FIG. 1) on the skewer mechanism 20 when extended. When the second retractable surface 64 is extended out and away from the singularizing mechanism 60, the cross section of the singularizing mechanism 60 at the second retractable surface 64 can be larger than the slots 46 in the cutlery 40. When the second retractable surface 64 is extended, the pieces of cutlery 40 are restrained from moving past the second retractable surface 64 to the lever 24 or to the cutlery landing surface 34. As such, the second retractable surface 64 can hold the cutlery stack 42 (FIG. 1) on the skewer mechanism 20 when extended.

When the lever 24 is in the resting position 50, the sliding cam 58 can allow the first retractable surface 62 to extend out of the singularizing mechanism 60 and can force the second retractable surface 64 to retract within the singularizing mechanism 60 (FIG. 3). When the lever 24 is in the actuated position 52, the sliding cam 58 can force the first retractable surface 62 to retract within the singularizing mechanism 60 and can force the second retractable surface 64 to extend out of the singularizing mechanism 60 (FIG. 4). Movement of the sliding cam 58 downward can retract the first retractable surface 62 and extend the second retractable surface 64, and movement of the sliding cam 58 upward can extend the first retractable surface 62 and retract the second retractable surface 64. When the lever 24 is in the resting position 50, the first retractable surface 62 can maintain the cutlery stack 42 on the skewer mechanism 20 above the first retractable surface 62.

When the lever 24 is moved to the actuated position 52, the first retractable surface 62 is retracted and the bottom piece of cutlery 41 falls past the first retractable surface 62 to separate or singularize the bottom piece of cutlery 41 from the remainder of the cutlery stack 42 (when the bottom piece of cutlery 41 is separated from the cutlery stack the next piece of cutlery in the cutlery stack becomes the new bottom piece of cutlery 41). When the lever 24 is moved from the resting position 50 to the actuated position 52, the second retractable surface 64 can extend and support the cutlery stack 42, and the first retractable surface 62 moves inward, allowing the bottom piece of cutlery 41 to fall and land on a staging shoulder or surface 70. The staging shoulder or surface 70 can support the separated piece of cutlery 43 (while the lever 24 is in the actuated position 52 to keep the separated piece of cutlery 43 from falling down the lever 24. As used herein, the term "separated piece of cutlery" is the bottom piece of cutlery 41 after it has been separated from the cutlery stack 42. Once the bottom piece of cutlery 41 separates from the stack 42 to become separated piece of cutlery 42, the stack 42 has a new bottom piece of cutlery 41 disposed at the bottom of the stack 42 and supported in place by the second retractable surface 64.

After the bottom piece of cutlery 41 is separated from the cutlery stack 42 and the lever 24 is moved from the actuated position 52 to the resting position 50, the staging shoulder 70 can be retracted and the separated piece of cutlery 43 can be guided using the lever 24 to the cutlery landing surface 34. When the lever 24 is moved from the actuated position 52 to the resting position 50, the second retractable surface 64 retracts (i.e. moves inward), the first retractable surface 62 is extended, the cutlery stack 42 falls from the support of the second retractable surface 64 to be supported by the extended first retractable surface 62.

Figure 5:
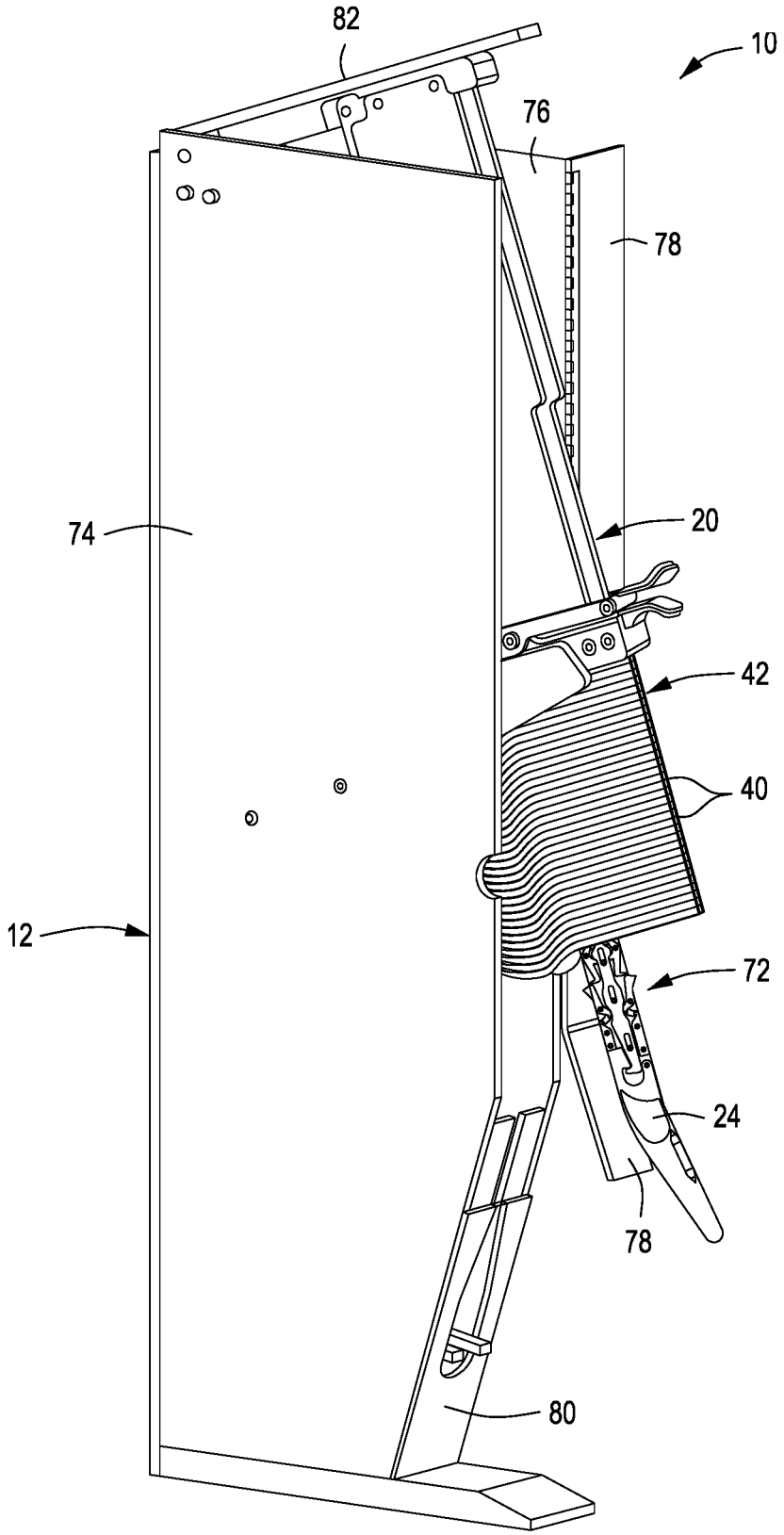
FIG. 5 depicts the skewer mechanism of the cutlery dispensing assembly in a loading position, according to one or more embodiments described.

FIG. 5 depicts the skewer mechanism 20 of the cutlery dispensing assembly 10 in a loading position 72, according to one or more embodiments. Cutlery dispensing assembly 10 can include a first housing side 74, a second housing side 76, a housing door 78, a front housing section 80, and a housing top 82. The housing sides 74 and 76, the housing door 78, the front housing section 80, and the housing top 82 can be connected to the chassis 12 and can protect the skewer mechanism 20 and the cutlery 40 from contaminants.

Figure 6:
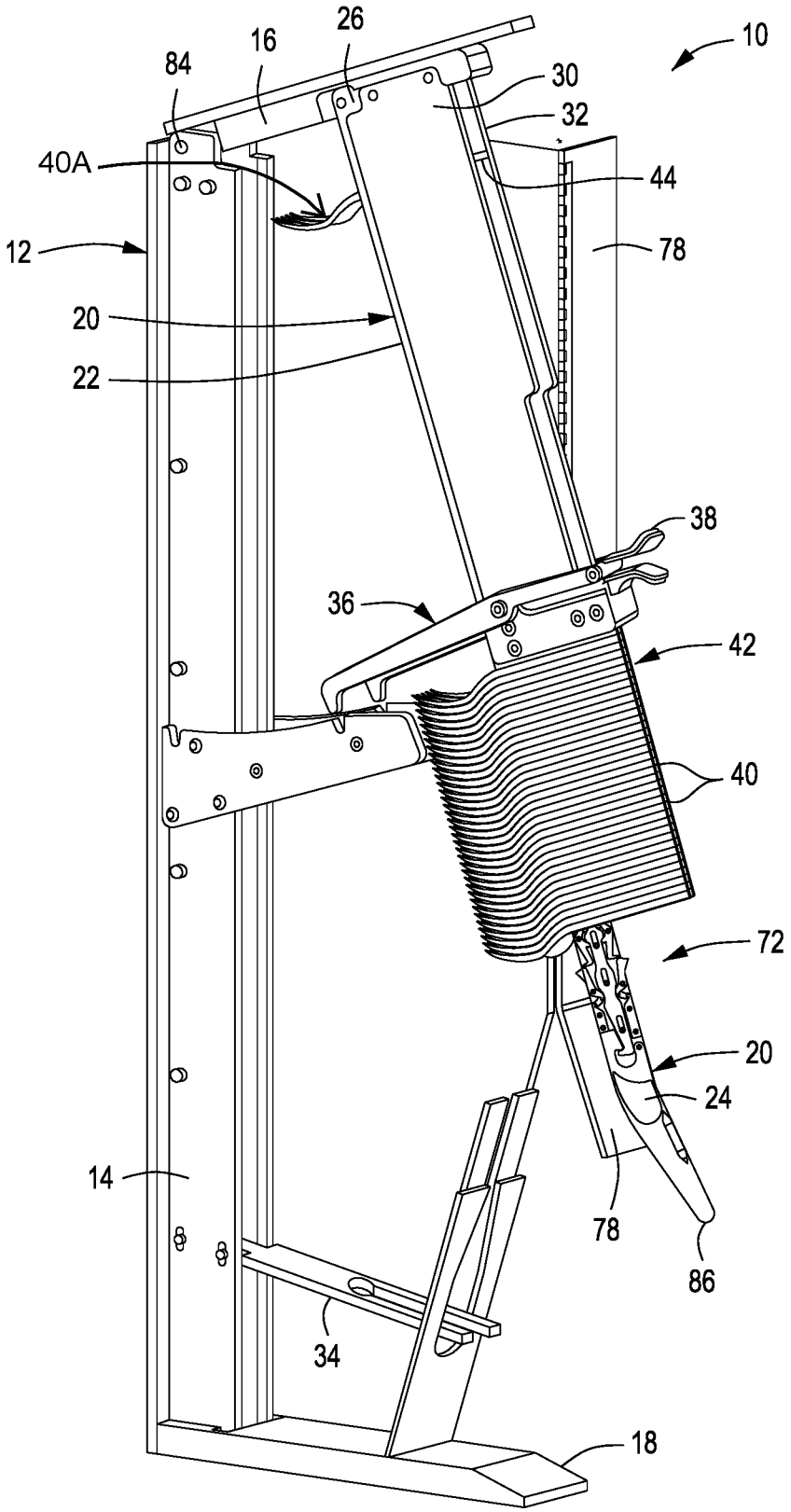
FIG. 6 depicts the cutlery dispensing assembly with a housing side removed, according to one or more embodiments described.

FIG. 6 depicts the cutlery dispensing assembly 10 in the loading position 72 with the first housing side 74 removed, according to one or more embodiments. The cutlery dispensing assembly 10 can include a latch mechanism 36 which can selectively latch the skewer mechanism 20 to the chassis 12 in the dispensing position 48 (FIG. 1) and in the loading position 72. The latch mechanism 36 can include a latch actuator 38 which can be used to manipulate the latch mechanism 36 for latching and unlatching. The latch mechanism 36 can maintain the skewer mechanism 20 at approximately a 20° angle from the backbone 14 when in the loading position 72. The latch actuator 38 can be or include a thumb lever. The latch actuator 38 can be pulled to unlock the latch mechanism 36 to allow the skewer mechanism 20 to move from the dispensing position 48 to the loading position 72.

Multiple pieces of cutlery 40 can be loaded into the cutlery dispensing assembly 10 to be later dispensed to consumers one piece of cutlery 40 at a time. Loading cutlery 40 onto the skewer mechanism 20 can be achieved by opening the housing door 78, using the latch actuator 38 to release the latch mechanism 36, and moving the skewer mechanism 20 from the dispensing position 48 (FIG. 1) to the loading position 72 (FIGS. 5 and 6). The latch mechanism 36 can then be locked in the loading position to hold the skewer mechanism 20 in the loading position 72 while the cutlery 40 is loaded.

The cutlery 40 can be loaded when the skewer mechanism 20 is in the loading position 72 by sliding the slots 46 of the cutlery 40 over a tip 86 of the lever 24 and pushing the cutlery 40 up toward the first end 26 of the body 22. The cutlery 40 can be loaded onto the skewer mechanism 20 separately or in cutlery stacks 42. The first retractable surface 62 (FIG. 3) can retract as the slots 46 of the loaded cutlery 40 pass the first retractable surface 62 so that the cutlery 40 can move past the first retractable surface 62 during loading. The slots 46 can have a larger cross section than the first retractable surface 62 at the bottom of the first retractable surface 62 and a smaller cross section at the top of the first retractable surface 62 such that pushing the cutlery 40 toward the first end 26 can put enough inward force on the first retractable surface 62 to cause the first retractable surface to retract enough to allow the cutlery 40 to pass. The first retractable surface springs 66 can re-extend the first retractable surface 62 after the cutlery 40 has been pushed past the first retractable surface 62 toward the first end 26 of the body 22 to support the loaded cutlery on the skewer mechanism 20. The cutlery 40 can be loaded onto the skewer mechanism 20 until the cutlery stack 42 reaches or nearly reaches the first end 26 of the body 22. It should be appreciated that the length of the elongated body 22 can determine the number of utensils 40 and number of stacks 42 that can be loaded on the skewer mechanism 20.

The skewer mechanism 20 can swing or rotate about a pivot at or toward the top of the chassis 12 to move the skewer mechanism 20 between the dispensing position 48 and the loading position 72. The movement of the skewer mechanism 20 from the dispensing position 48 to the loading position 72 can expose the tip 86 of the lever 24. The skewer mechanism 20 can be connected to the upper support frame 16 and the upper support frame 16 can be pivotally connected to the backbone 14 through a hinge 84; the skewer mechanism 20 can rotate about the hinge 84 to move between the dispensing position 48 and the loading position 72.

In the loading position 72, the lever 24 of the skewer mechanism 20 can be positioned at a sufficient distance from the cutlery landing surface 34 to allow a single cutlery 40 and/or a cutlery stack 42 having multiple cutlery 40 to be introduced onto the body 22 of the skewer mechanism 20. Multiple cutlery 40 in a cutlery stack 42 can be packaged together and the package (not shown) can be removed from the cutlery stack 42 after the cutlery stack 42 is loaded in the cutlery dispensing assembly 10. A cutlery 40A is shown in FIG. 6 for illustrating how the handles 44 can extend between the first guide 30 and the second guide 32 of the skewer mechanism 20.

After the cutlery 40 is loaded on the skewer mechanism 20, the skewer mechanism can be moved back to the dispensing position 48 by unlatching the skewer mechanism 20 from the loading position 72 and re-latching the skewer mechanism 20 in the dispensing position 48. To prepare the cutlery dispensing assembly 10 for consumer use after loading, the lever 24 can be moved to the actuated position 52 to separate a bottom piece of cutlery 41 from the loaded cutlery stack 42. The lever 24 can then be released to allow the lever 24 to return to the resting position 50 which guides the separated piece of cutlery 43 to the cutlery landing surface 34 as the separated piece of cutlery 43 moves downward under the force of gravity. The housing door 78 can then be closed and the cutlery dispensing assembly 10 can be used by consumers.

Figure 7:
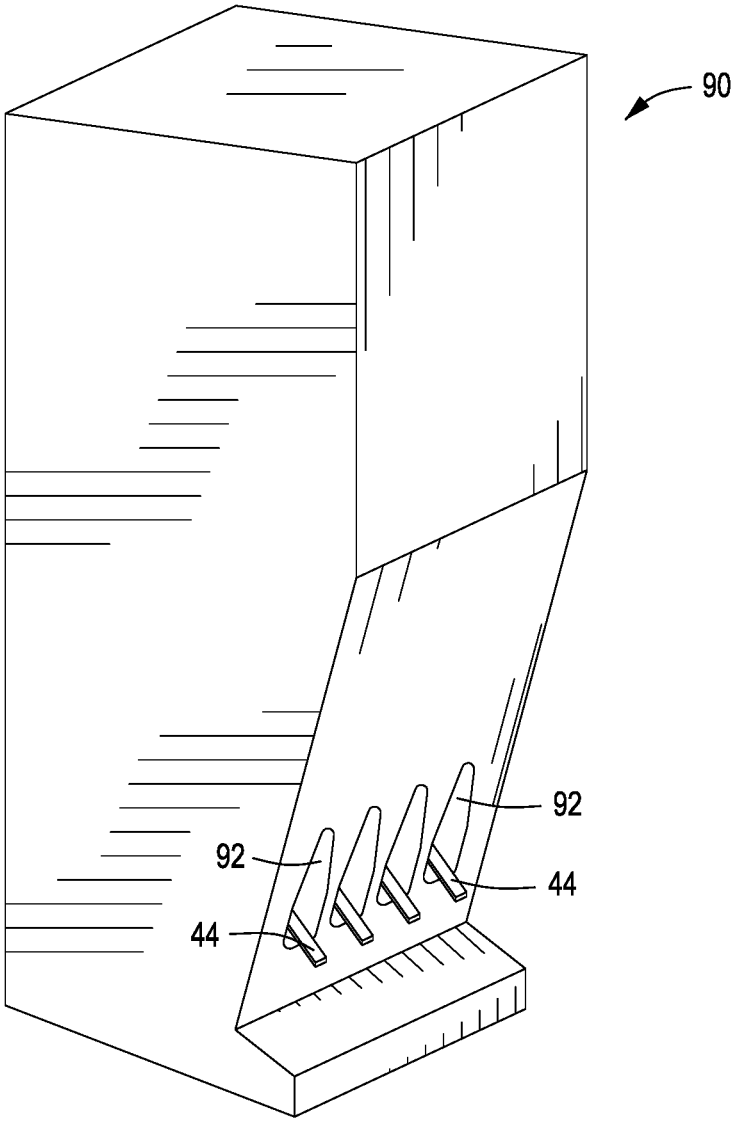
FIG. 7 depicts a cutlery dispenser having multiple cutlery dispensing assemblies, according to one or more embodiments described.

FIG. 7 depicts a cutlery dispenser 90 having multiple cutlery dispensing assemblies 10, according to one or more embodiments. The cutlery dispenser 90 can have one or more cutlery dispensing assemblies 10 and can be arranged to allow access to the handles 44 of the separated pieces of cutlery 43 through openings 92 while restricting access to the cutlery dispensing assemblies 10. The cutlery dispenser 90 can be used in restaurants to dispense cutlery 40 to consumers while restricting the customers from accessing the cutlery stack 42.

The cutlery dispensing assembly 10 having the skewer mechanism 20 can serve cutlery 40 to consumers in a more hygienic and reliable manner than conventional cutlery dispensing assemblies since the consumer only has to touch the handle of the cutlery that they are going to use. The cutlery dispensing assembly 10 can also accommodate partially wrapped pieces of cutlery 40 (i.e. wrap over utility end of cutlery utensil) thus providing additional hygiene benefits to customer. The skewer mechanism 20 can control the orientation of the cutlery 40 in the cutlery dispensing assembly 10 in a way that can prevent the cutlery dispensing assembly 10 from jamming and can reliably provide the cutlery 40 to the customer. The cutlery 40 can be held and maintained on the skewer mechanism 20 from the time the cutlery 40 is inserted into the cutlery dispensing assembly 10 until the consumer removes the cutlery 40 from the cutlery landing surface 34. By allowing the skewer mechanism 20 to fit within the slot 46 of each piece of cutlery, the skewer mechanism 20 controls the movement and orientation of the cutlery 40 in a continuous manner throughout the entire loading and dispensing process.

Embodiments of the present disclosure further relate to any one or more of the following paragraphs.

A cutlery dispensing assembly configured to dispense at least two pieces of cutlery, comprising: a chassis; and a skewer mechanism disposed at least partially within the chassis and configured to contain a stack of the cutlery, wherein the stack of the cutlery comprises a bottom piece of cutlery and at least one other piece of cutlery and wherein each piece of cutlery has an opening through which the skewer mechanism is configured to pass, the skewer mechanism comprising: an elongated body configured to pass through the opening of each piece of cutlery in the stack of the cutlery; and a lever extending from elongated the body, the lever configured to move between a first position in which the lever is configured to retain a separated piece of cutlery, and a second position in which the lever is configured to release the separated piece of cutlery from the lever, wherein the bottom piece of cutlery becomes the separated piece of cutlery after it has been separated from the stack of the cutlery.

The cutlery dispensing according to the preceding paragraph, wherein the skewer mechanism further comprises a singularizing mechanism that is configured to separate the bottom piece of cutlery from the stack of the cutlery in response to movement of the lever between the first position and the second position.

The cutlery dispensing assembly according to any one or more of the preceding paragraphs, wherein the singularizing mechanism further comprises a shoulder stop that is configured to catch the bottom piece of cutlery after being separated from the stack of the cutlery in response to movement of the lever between the first position and the second position.

The cutlery dispensing assembly according to any one or more of the preceding paragraphs, wherein the lever is configured to move from the first position to the second position upon removal of the separated piece of cutlery.

The cutlery dispensing assembly according to any one or more of the preceding paragraphs, wherein the singularizing mechanism further comprises at least one first retractable surface that is extendable from the singularizing mechanism when the lever is in the first position and configured to restrict the bottom piece of cutlery from separating from the stack of the cutlery when the lever is in the first position, and wherein the first retractable surface is at least partially retractable into the singularizing mechanism when the lever is in the second position and configured to allow the bottom piece of cutlery to release from the stack of the cutlery when the lever is in the second position.

The cutlery dispensing assembly according to any one or more of the preceding paragraphs, wherein the singularizing mechanism further comprises at least one second retractable surface, wherein the second retractable surface is extendable from the singularizing mechanism when the lever is in the second position and configured to restrict the bottom piece of cutlery from moving past the second retractable surface when the lever is in the second position, and wherein the second retractable surface is retractable into the singularizing mechanism when the lever is in the first position and configured to allow the bottom piece of cutlery to release to the first retractable surface when the lever is in the first position.

The cutlery dispensing assembly according to any one or more of the preceding paragraphs, further comprising a first retractable surface spring that biases the first retractable surface to extend from the singularizing mechanism and a second retractable surface spring that biases the second retractable surface to at least partially retract into the singularizing mechanism.

The cutlery dispensing assembly according to any one or more of the preceding paragraphs, wherein the lever is configured to guide the separated piece of cutlery onto the cutlery landing surface from the stack of the cutlery while the separated piece of cutlery is moving under the force of gravity.

The cutlery dispensing assembly according to any one or more of the preceding paragraphs, wherein the elongated body is configured to pivot between a dispensing position, in which the lever, while in the first position, is configured to guide the separated piece of cutlery onto the cutlery landing surface, and a loading position in which the lever is configured to be a sufficient distance from the cutlery landing surface to allow the stack of the cutlery to be loaded onto the elongated body of the skewer mechanism.

The cutlery dispensing assembly according to any one or more of the preceding paragraphs, further comprising a hinge at least partially forming a connection between the elongated body and the chassis, wherein the body pivots on the hinge between the dispensing position and the loading position.

The cutlery dispensing assembly according to any one or more of the preceding paragraphs, further comprising a latch mechanism configured to selectively latch the elongated body in the dispensing position and to selectively latch the skewer mechanism in the loading position.

The cutlery dispensing assembly according to any one or more of the preceding paragraphs, wherein the first retractable surface, while in the loading position, is configured to at least partially retract into the skewer mechanism as the stack of cutlery is moved over the first retractable surface to allow the stack of the cutlery to be moved toward a first end of the body, and configured to pivot outward and away from the skewer mechanism to maintain the stack of the cutlery on the elongated body after the cutlery is loaded.

A cutlery dispensing assembly configured to dispense at least two pieces of cutlery, comprising: a chassis comprising a backbone, an upper support frame located at an upper end of the backbone, and a base located at a lower end of the backbone; a cutlery landing surface connected to the chassis between the upper support frame and the base; and a skewer mechanism disposed on the chassis and configured to contain a stack of the cutlery, wherein the stack of the cutlery comprises a bottom piece of cutlery and each piece of cutlery in the stack of the cutlery has an opening through which the skewer mechanism is configured to pass, the skewer mechanism comprising: an elongated body having a first end and a second end, wherein the first end is connected to the chassis, and the second end is configured to pass through the opening of each piece of cutlery in the stack of the cutlery; a lever disposed on the second end of the body, the lever configured to move between a first position in which the lever is configured to retain a separated piece of cutlery on the cutlery landing surface, wherein the bottom piece of cutlery becomes the separated piece of cutlery after it has been separated from the stack of the cutlery, and a second position in which the lever is configured to release the separated piece of cutlery from the cutlery landing surface to a user; and a singularizing mechanism configured to separate the bottom piece of cutlery from the stack of the cutlery in response to movement of the lever between the first position and the second position.

The cutlery dispensing assembly according to the preceding paragraph, wherein the lever is configured to move from the first position to the second position upon removal of the separated piece of cutlery from the cutlery landing surface.

The cutlery dispensing assembly according to any one or more of the preceding paragraphs, wherein the singularizing mechanism further comprises: at least one first retractable surface, wherein the first retractable surface is extended from the singularizing mechanism when the lever is in the first position and configured to restrict the bottom piece of cutlery from separating from the stack of the cutlery when the lever is in the first position and the first retractable surface is retracted into the singularizing mechanism when the lever is in the second position and configured to allow the bottom piece of cutlery to fall from the stack of the cutlery when the lever is in the second position; and at least one second retractable surface, wherein the second retractable surface is extended from the singularizing mechanism when the lever is in the second position and configured to restrict the bottom piece of cutlery from moving past the second retractable surface when the lever is in the second position and the second retractable surface is retracted into the singularizing mechanism when the lever is in the first position and configured to allow the bottom piece of cutlery to fall to the first retractable surface when the lever is in the first position.

The cutlery dispensing assembly according to any one or more of the preceding paragraphs, further comprising a first retractable surface spring that biases the first retractable surface to extend from the singularizing mechanism and a second retractable surface spring that biases the second retractable surface to at least partially retract into the singularizing mechanism.

The cutlery dispensing assembly according to any one or more of the preceding paragraphs, wherein the lever is configured to guide the separated piece of cutlery onto the cutlery landing surface from the stack of the cutlery while the separated next piece of cutlery is moving under the force of gravity.

The cutlery dispensing assembly according to any one or more of the preceding paragraphs, wherein the body is configured to pivot between a dispensing position, in which the lever, while in the first position, is configured to guide the separated piece of cutlery onto the cutlery landing surface, and a loading position in which the lever is configured to be a sufficient distance from the cutlery landing surface to allow the stack of the cutlery to be introduced onto the body of the skewer mechanism.

The cutlery dispensing assembly according to any one or more of the preceding paragraphs, further comprising: a hinge at least partially forming the connection between the backbone and the upper support frame, and wherein the body pivots on the hinge between the dispensing position and the loading position, and a latch mechanism configured to selectively latch the body in the dispensing position and to selectively latch the skewer mechanism in the loading position.

The cutlery dispensing assembly according to any one or more of the preceding paragraphs, wherein the body is configured to pivot between a dispensing position, in which the lever, while in the first position, is configured to guide the separated piece of cutlery onto the cutlery landing surface, and a loading position in which the lever is configured to be a sufficient distance from the cutlery landing surface to allow the stack of the cutlery to be introduced onto the body of the skewer mechanism, and wherein the first retractable surface, while in the loading position, is configured to at least partially retract into the skewer mechanism as the stack of cutlery is moved over the first retractable surface to allow the stack of the cutlery to be moved toward a first end of the body, and configured to extend outward and away from the skewer mechanism to maintain the stack of the cutlery on the elongated body after the cutlery is loaded.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A cutlery dispensing assembly configured to dispense at least two pieces of cutlery, comprising:

a chassis; and a skewer mechanism disposed at least partially within the chassis and configured to contain a stack of the cutlery, wherein the stack of the cutlery comprises a bottom piece of cutlery and at least one other piece of cutlery and wherein each piece of cutlery has an opening through which the skewer mechanism is configured to pass, the skewer mechanism comprising:

an elongated body configured to pass through the opening of each piece of cutlery in the stack of the cutlery; and a lever extending from elongated the body, the lever configured to move between a first position in which the lever retains a separated piece of cutlery, and a second position in which the lever releases the separated piece of cutlery from the lever, wherein the bottom piece of cutlery becomes the separated piece of cutlery after it has been separated from the stack of the cutlery.

2. The cutlery dispensing assembly of claim 1, wherein the lever is configured to guide the separated piece of cutlery onto the cutlery landing surface from the stack of the cutlery while the separated piece of cutlery is moving under the force of gravity.

3. The cutlery dispensing assembly of claim 1, wherein the lever is configured to move from the first position to the second position upon removal of the separated piece of cutlery.

4. The cutlery dispensing assembly of claim 1, wherein the skewer mechanism further comprises a singularizing mechanism that is configured to separate the bottom piece of cutlery from the stack of the cutlery in response to movement of the lever between the first position and the second position.

5. The cutlery dispensing assembly of claim 4, wherein the singularizing mechanism further comprises a shoulder stop that is configured to catch the bottom piece of cutlery after being separated from the stack of the cutlery in response to movement of the lever between the first position and the second position.

6. The cutlery dispensing assembly of claim 4, wherein the singularizing mechanism further comprises at least one first retractable surface that is extendable from the singularizing mechanism when the lever is in the first position and configured to restrict the bottom piece of cutlery from separating from the stack of the cutlery when the lever is in the first position, and wherein the first retractable surface is at least partially retractable into the singularizing mechanism when the lever is in the second position and configured to allow the bottom piece of cutlery to release from the stack of the cutlery when the lever is in the second position.

7. The cutlery dispensing assembly of claim 6, wherein the singularizing mechanism further comprises at least one second retractable surface, wherein the second retractable surface is extendable from the singularizing mechanism when the lever is in the second position and configured to restrict the bottom piece of cutlery from moving past the second retractable surface when the lever is in the second position, and wherein the second retractable surface is retractable into the singularizing mechanism when the lever is in the first position and configured to allow the bottom piece of cutlery to release to the first retractable surface when the lever is in the first position.

8. The cutlery dispensing assembly of claim 7, further comprising a first retractable surface spring that biases the first retractable surface to extend from the singularizing mechanism and a second retractable surface spring that biases the second retractable surface to at least partially retract into the singularizing mechanism.

9. The cutlery dispensing assembly of claim 1, wherein the elongated body is configured to pivot between a dispensing position, in which the lever, while in the first position, is configured to guide the separated piece of cutlery onto the cutlery landing surface, and a loading position in which the lever is configured to be a sufficient distance from the cutlery landing surface to allow the stack of the cutlery to be loaded onto the elongated body of the skewer mechanism.

10. The cutlery dispensing assembly of claim 9, further comprising a hinge at least partially forming a connection between the elongated body and the chassis, wherein the body pivots on the hinge between the dispensing position and the loading position.

11. The cutlery dispensing assembly of claim 9, further comprising a latch mechanism configured to selectively latch the elongated body in the dispensing position and to selectively latch the skewer mechanism in the loading position.

12. The cutlery dispensing assembly of claim 9, wherein the first retractable surface, while in the loading position, is configured to at least partially retract into the skewer mechanism as the stack of cutlery is moved over the first retractable surface to allow the stack of the cutlery to be moved toward a first end of the body, and configured to pivot outward and away from the skewer mechanism to maintain the stack of the cutlery on the elongated body after the cutlery is loaded.

13. A cutlery dispensing assembly configured to dispense at least two pieces of cutlery, comprising:

a chassis comprising a backbone, an upper support frame located at an upper end of the backbone, and a base located at a lower end of the backbone;

a cutlery landing surface connected to the chassis between the upper support frame and the base; and a skewer mechanism disposed on the chassis and configured to contain a stack of the cutlery, wherein the stack of the cutlery comprises a bottom piece of cutlery and each piece of cutlery in the stack of the cutlery has an opening through which the skewer mechanism is configured to pass, the skewer mechanism comprising:

an elongated body having a first end and a second end, wherein the first end is connected to the chassis, and the second end is configured to pass through the opening of each piece of cutlery in the stack of the cutlery;

a lever disposed on the second end of the body, the lever configured to move between a first position in which the lever is configured to retain a separated piece of cutlery on the cutlery landing surface, wherein the bottom piece of cutlery becomes the separated piece of cutlery after it has been separated from the stack of the cutlery, and a second position in which the lever is configured to release the separated piece of cutlery from the cutlery landing surface to a user; and a singularizing mechanism configured to separate the bottom piece of cutlery from the stack of the cutlery in response to movement of the lever between the first position and the second position.

14. The cutlery dispensing assembly of claim 13, wherein the lever is configured to move from the first position to the second position upon removal of the separated piece of cutlery from the cutlery landing surface.

15. The cutlery dispensing assembly of claim 13, wherein the lever is configured to guide the separated piece of cutlery onto the cutlery landing surface from the stack of the cutlery while the separated next piece of cutlery is moving under the force of gravity.

16. The cutlery dispensing assembly of claim 13, wherein the body is configured to pivot between a dispensing position, in which the lever, while in the first position, is configured to guide the separated piece of cutlery onto the cutlery landing surface, and a loading position in which the lever is configured to be a sufficient distance from the cutlery landing surface to allow the stack of the cutlery to be introduced onto the body of the skewer mechanism.

17. The cutlery dispensing assembly of claim 13, wherein the singularizing mechanism further comprises:

at least one first retractable surface, wherein the first retractable surface is extended from the singularizing mechanism when the lever is in the first position and configured to restrict the bottom piece of cutlery from separating from the stack of the cutlery when the lever is in the first position and the first retractable surface is retracted into the singularizing mechanism when the lever is in the second position and configured to allow the bottom piece of cutlery to fall from the stack of the cutlery when the lever is in the second position; and at least one second retractable surface, wherein the second retractable surface is extended from the singularizing mechanism when the lever is in the second position and configured to restrict the bottom piece of cutlery from moving past the second retractable surface when the lever is in the second position and the second retractable surface is retracted into the singularizing mechanism when the lever is in the first position and configured to allow the bottom piece of cutlery to fall to the first retractable surface when the lever is in the first position.

18. The cutlery dispensing assembly of claim 17, further comprising a first retractable surface spring that biases the first retractable surface to extend from the singularizing mechanism and a second retractable surface spring that biases the second retractable surface to at least partially retract into the singularizing mechanism.

19. The cutlery dispensing assembly of claim 13, further comprising:

a hinge at least partially forming the connection between the backbone and the upper support frame, and wherein the body pivots on the hinge between the dispensing position and the loading position, and a latch mechanism configured to selectively latch the body in the dispensing position and to selectively latch the skewer mechanism in the loading position.

20. The cutlery dispensing assembly of claim 19, wherein the body is configured to pivot between a dispensing position, in which the lever, while in the first position, is configured to guide the separated piece of cutlery onto the cutlery landing surface, and a loading position in which the lever is configured to be a sufficient distance from the cutlery landing surface to allow the stack of the cutlery to be introduced onto the body of the skewer mechanism, and wherein the first retractable surface, while in the loading position, is configured to at least partially retract into the skewer mechanism as the stack of cutlery is moved over the first retractable surface to allow the stack of the cutlery to be moved toward a first end of the body, and configured to extend outward and away from the skewer mechanism to maintain the stack of the cutlery on the elongated body after the cutlery is loaded.

* * * * *